US006036364A

United States Patent [19]

Heuvel

[11] Patent Number: 6,036,364

[45] Date of Patent: Mar. 14, 2000

[54] TWO-PIECE SLIDING FASTENER ARRANGEMENT FOR ATTACHMENT TO CONTAINER

[75] Inventor: Gregory Vanden Heuvel, Kaukauna, Wis.

[73] Assignee: Reynolds Consumer Products, Inc., Appleton, Wis.

[21] Appl. No.: 09/007,926

[22] Filed: Jan. 16, 1998

[51] Int. Cl.[7] ..... B65D 33/24

[52] U.S. Cl. ..... 383/64; 24/399; 24/415; 24/430

[58] Field of Search ..... 24/64, 69, 387, 24/388, 390, 403, 409, 410, 416, 400, 399, 417, 427, 430, 431, 433, 434, 435; 383/64, 69

[56] References Cited

U.S. PATENT DOCUMENTS

| | | | |
|---|---|---|---|
| 2,157,084 | 5/1939 | Rafael | 24/417 |
| 2,590,106 | 3/1952 | Lackritz | 24/416 |
| 2,590,107 | 3/1952 | Lackritz | 24/416 |
| 3,713,923 | 1/1973 | Laguerre . | |
| 4,966,470 | 10/1990 | Thompson et al. . | |
| 4,971,454 | 11/1990 | Branson et al. . | |
| 5,167,608 | 12/1992 | Steffens, Jr. et al. . | |
| 5,211,482 | 5/1993 | Tilman . | |
| 5,871,281 | 2/1999 | Stolmeier et al. . | |

*Primary Examiner*—James R. Brittain
*Attorney, Agent, or Firm*—Alan M. Biddison

[57] ABSTRACT

A fastener arrangement for use with a container having a reclosable profile includes a slider having walls forming a cavity for receiving an edge of the container. The walls are shaped to close the reclosable profile when the slider is slid in one direction. A retainer holds the walls together and also serves to open the reclosable profile when the slider is slid in the other direction.

28 Claims, 5 Drawing Sheets

TWO-PIECE SLIDING FASTENER ARRANGEMENT FOR ATTACHMENT TO CONTAINER

FIELD OF THE INVENTION

The present invention relates to fastener arrangements for containers. More particularly, the present invention relates to sliding fastener arrangements for reclosable containers.

BACKGROUND OF THE INVENTION

Many consumer packaging applications employ containers, such as reclosable plastic bags. These bags employ reclosable zippers for locking products within the bags. A typical reclosable zipper includes male and female closures extending along the length of the zipper. In one conventional implementation, the male closure is tree-shaped, with an extended portion arranged to interlock between two extended portions of a mating female closure disposed opposite to the male closure. The closures are interlocked by properly aligning the male and female closures and pressing the closures together along the length of the zipper.

Some types of zippers are opened and closed using sliders. Typical slider zipper designs include a separator or plow-type structure that opens the zipper when the slider travels in one direction along the zipper. The side walls are tapered so as to close the zipper when the slider travels along the zipper in the opposite direction. The slider is adapted to be assembled with the zipper by an endwise assembly or by a relative transverse maneuver. Assembling the slider on the zipper, however, potentially deforms the plastic zipper elements and can compromise the integrity of the seal formed by closing the zipper.

The integrity of the seal can also be compromised by various structural features of the bag. For example, the separator extends through the zipper profile and fits around the base of the profile on the inside of the bag. When a slider having this type of separator is moved to close the bag, a side seal on the side of the bag prevents the slider from traveling off the end of the bag. The side seal holds the zipper closed, thus stopping the separator from moving further. However, the side seal does not allow the slider to sit tightly against it. Consequently, a passageway is formed that can allow the contents of the bag to leak out. Fluids are particularly prone to leaking.

SUMMARY OF THE INVENTION

According to one embodiment, the present invention is directed to a fastener arrangement for use with a container edge of a container having a reclosable profile. The fastener arrangement includes a slider having first and second walls that form a first cavity for receiving the container edge and the reclosable profile. The slider is positionable to slide along the container edge in a first direction to close the reclosable profile. The fastener arrangement also includes a retaining member having a portion thereof configured and arranged for location within a second cavity to secure the retaining member in the slider. The retaining member also has a portion thereof that is positionable in the first cavity and shaped to open the reclosable profile when the slider is slid in a direction opposite the first direction.

Another embodiment of the present invention is directed to a reclosable package comprising a film having interior and exterior surfaces arranged to form a pouch. A reclosable profile is disposed proximate to an edge of the film. A slider has first and second walls that form a first cavity for receiving the edge. The slider is configured and arranged to slide along the edge in a first direction to close the reclosable profile. The reclosable package also includes a retaining member sized for location in the slider and configured and arranged to maintain the first and second walls in a position forming the first cavity and configured and arranged to open the reclosable profile when the slider is slid in a direction opposite to the first direction. The retaining member has protrusions configured and arranged to secure the retaining member in the second cavity.

According to another embodiment of the present invention, a fastener arrangement for use with a container edge of a container having a reclosable profile is constructed by providing a strip having first and second portions. The first and second portions are arranged in a position to form a slider. The slider has a first cavity for receiving the container edge and has a second cavity. The slider is configured to slide along the container edge in a first direction to close the reclosable profile. A retaining member is inserted into the slider. The retaining member maintains the first and second portions in a position to form the first cavity and to open the reclosable profile when the slider is slid in a second direction. The retaining member has protrusions configured and arranged to secure the retaining member in the second cavity.

The above summary of the present invention is not intended to describe each illustrated embodiment or every implementation of the present invention. The figures and the detailed description that follow more particularly exemplify these embodiments.

BRIEF DESCRIPTION OF THE DRAWINGS

Other aspects and advantages of the present invention will become apparent upon reading the following detailed description and upon reference to the drawings in which.

Figure 1:
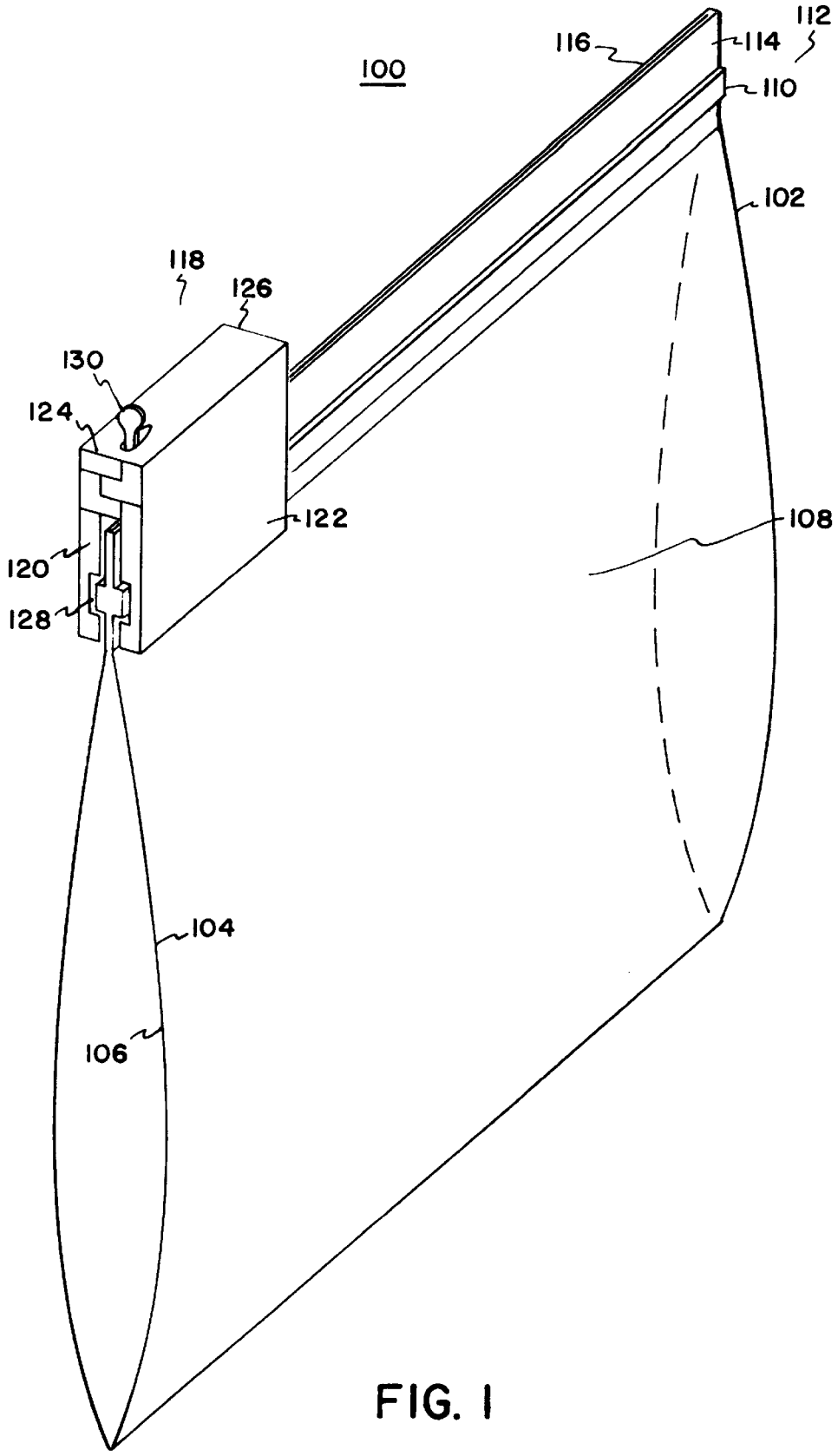
FIG. 1 illustrates a reclosable bag having a fastener arrangement, according to an embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

The present invention is believed to be applicable to closure arrangements for containers. The invention has been found to be particularly advantageous in reclosable bags with sliding zipper arrangements. Accordingly, in the discussion that follows, the present invention is discussed in the example context of reclosable bags or packages.

According to one implementation consistent with the present invention, a fastener arrangement includes a slider having first and second walls held together by a retaining pin. The first and second walls contain interleaving sections configured and arranged to receive the retaining pin so that, when the pin is inserted through the interleaving sections, the walls of the slider cannot be separated. The slider walls form a first cavity below the interleaving sections. These portions of the walls forming the cavity are tapered so that by sliding the slider, the closure arrangement of the bag or package is forced closed. The retaining pin has an end, positionable in the first cavity, that is wedge- or teardrop-shaped so that the pin can be slid along with the slider to wedge the closure arrangement open.

Referring now to the drawings, FIG. 1 illustrates an example flexible package 100 according to an embodiment of the present invention. The package 100 is constructed from a film 102, which is formed into a pouch having an exterior surface 104 and an interior surface 106. The interior surface 106 of the film 102 defines a reservoir 108 for storing, e.g., particulate material or liquid (not shown). A reclosable profile 110 is disposed on a top portion 112 of the package 100. In the embodiment illustrated in FIG. 1, the top portion 112 includes a flange or skirt 114 between the reclosable profile 110 and a top edge 116 of the package 100. In an alternative embodiment, the skirt 114 is absent and the reclosable profile 110 is disposed along the top edge 116.

The package 100 can be constructed using any of a variety of manufacturing techniques. One such known technique is referred to as a form-fill-seal technique. For detailed information concerning such techniques, reference may be made to the following U.S. Patents: Vertical Form, Fill and Seal Machine for Making Reclosable Bags (U.S. Pat. No. 5,505,037); Vertical Form, Fill and Seal Machine for Making Reclosable Product Filled Bags (U.S. Pat. No. 5,400,565); Apparatus and Method of Transverse Sealing for a Form-Fill-Seal Packaging Machine (U.S. Pat. No. 5,279,098); Control System for Package Making Machine (U.S. Pat. No. 4,128,985); and Control System for Package Making Machine (U.S. Pat. No. 4,023,327). Each of these patents is incorporated herein by reference.

Figure 2:
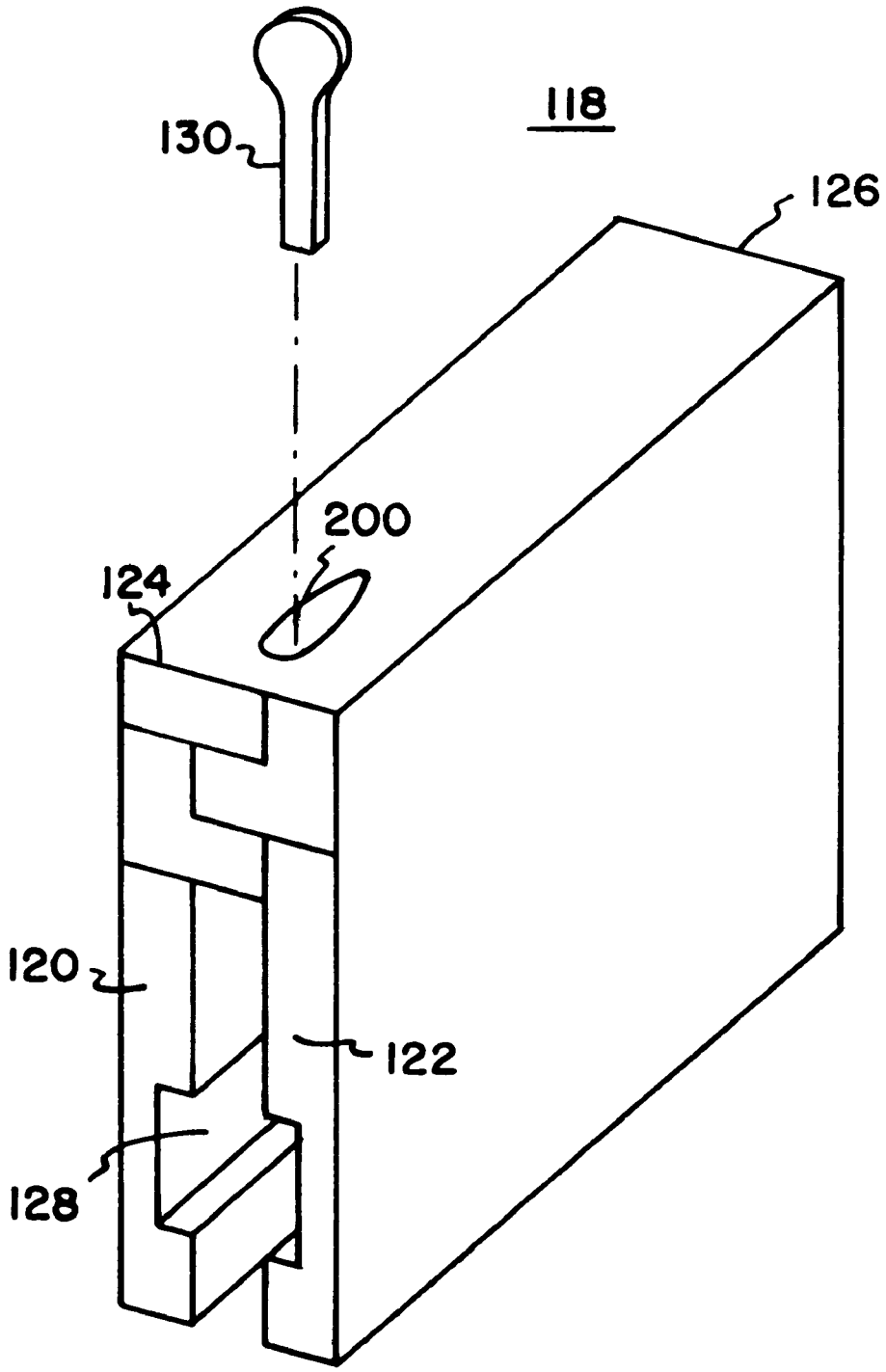
FIG. 2 illustrates an exploded view of an assembled fastener arrangement, according to another embodiment of the present invention.

A slider 118, illustrated in a magnified view in FIG. 2, opens and closes the reclosable profile 110. The slider 118 has walls 120 and 122 with inner surfaces that are tapered from one end 124 to the other end 126 of the slider 118. The walls 120 and 122 form a cavity 128 that receives the reclosable profile 110. When the slider 118 is moved in one direction along the top edge 116, the tapered shape of the inner walls pinches the reclosable profile 110 closed. With the reclosable profile 110 closed, the contents of the package 100 are substantially prevented from leaking out of the package 100.

A retainer 130 is inserted into the top of the slider 118. As depicted in FIG. 2, the walls 120 and 122 form a cavity 200 for receiving the retainer 130. The retainer 130 extends into the reclosable profile (110 of FIG. 1) and has a teardrop-shaped (or wedge-shaped) cross-section along at least part of its length. When the slider 118 is moved in the other direction along the top edge 116, the retainer 130 forces the reclosable profile 110 open, thus providing access to the contents of the package 100. More specific embodiments of such a retainer 130 are discussed in connection with FIGS. 4*a,* 4*b* and 5.

Figure 3:
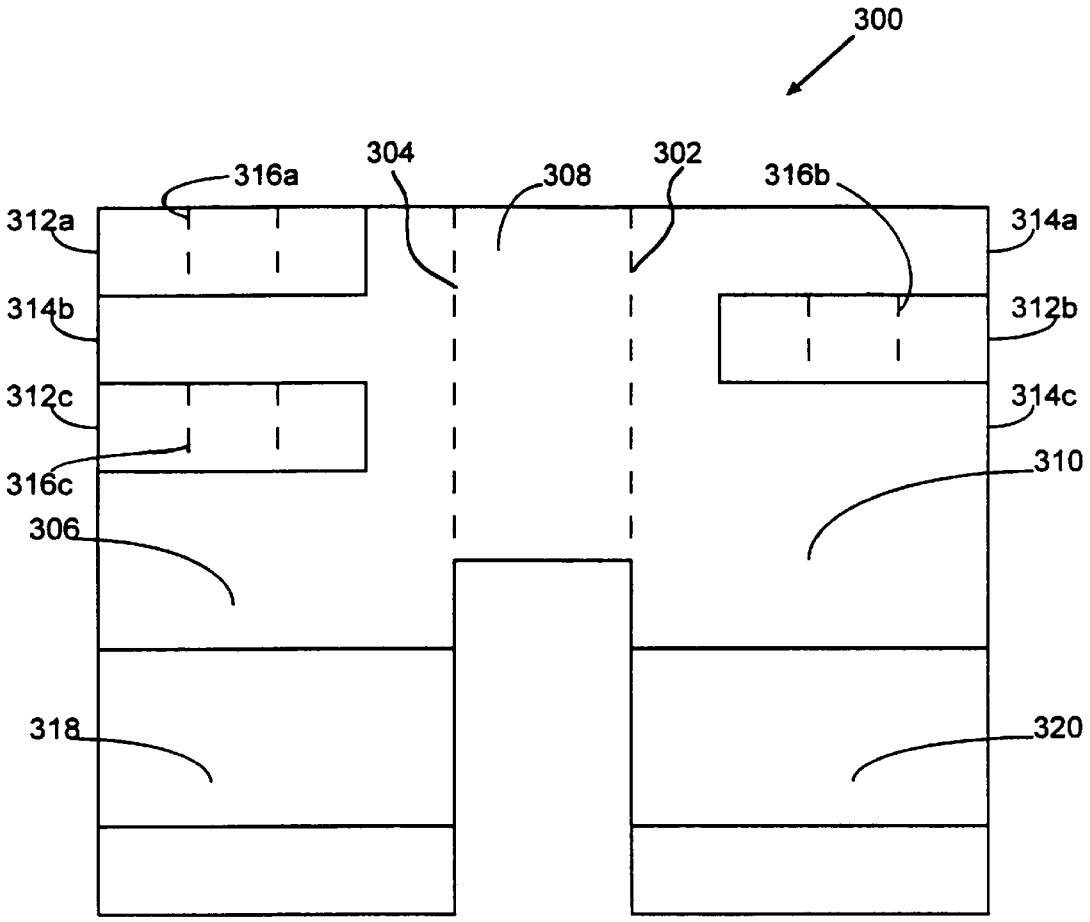
FIG. 3 illustrates an unassembled fastener arrangement, according to another embodiment of the present invention.

According to another important aspect of one embodiment of the present invention, the slider 118 can be constructed from a strip 300 of polymeric material, as depicted in the open-faced view of FIG. 3. The strip 300 is formed, e.g., molded, to be foldable along lines 302 and 304. The lines 302 and 304 conceptually divide the strip into regions 306, 308, and 310. Projections 312*a,* 312*b,* and 312*c* extending upward from the regions 306 and 310 are arranged to engage corresponding recessed regions 314*a,* 314*b,* and 314*c* when the strip 300 is folded along the lines 302 and 304. In addition, the projections 312*a,* 312*b,* and 312*c* have respective teardrop-shaped apertures 316*a,* 316*b,* and 316*c* (as indicated by the dashed lines in the projections 312*a,* 312*b,* and 312*c*). These apertures are arranged to align with each other when the strip 300 is folded along the lines 302 and 304. A retaining member, such as 130 of FIG. 2, is inserted into a cavity formed by the apertures 316*a,* 316*b,* and 316*c*. Locating the retaining member in this cavity prevents the walls from separating. An expansion at the bottom of the retaining member can be used to prevent its escape from this locking position.

The retaining member maintains the regions 306 and 310 in a position to form the walls of the slider. The region 308 forms one end of the slider, while the outer edges of the regions 306 and 310 form the other end of the slider. Moreover, recessions 318 and 320 define a cavity for receiving a reclosable profile when the regions 306 and 310 are maintained in the engaged position. The recessions 318 and 320 are tapered from the outer edges of the strip 300 toward the respective lines 304 and 302. Accordingly, the cavity formed by the recessions 318 and 320 is wider at one end of the slider than at the other. When the slider is moved in one direction along the edge of the container, the narrower end of the cavity pinches the reclosable profile closed.

Figure 4A:
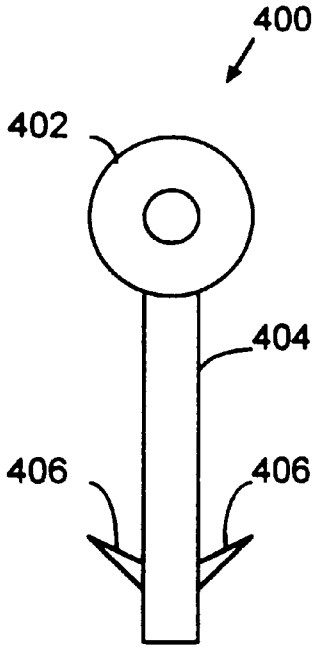
FIGS. 4*a* and 4*b* respectively illustrate elevational and profile views of a retaining member that is part of a fastener arrangement, according to an embodiment of the present invention.
Figure 4B:
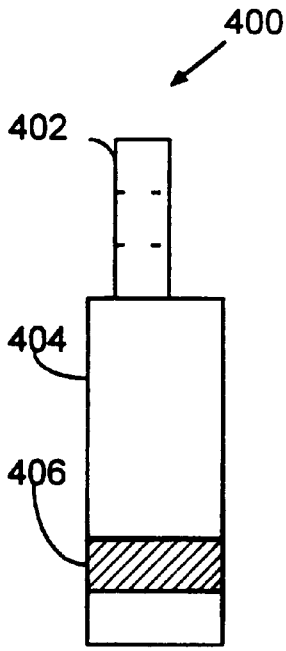

FIGS. 4*a* and 4*b* respectively illustrate front and side views of an example embodiment of a retaining member 400 that can be inserted into the slider. The retaining member 400 includes a head portion 402 that can be gripped easily to facilitate pulling the slider along the edge of the container. A stem portion 404 is inserted into the slider to prevent it from unfolding. In one specific embodiment, the retaining member 400 includes barb-like protrusions 406 that engage the lower surface of the projection 312*c* to secure the stem portion 404 in the slider and prevent the retaining member 400 from popping out of the slider. The stem portion 404 has a teardrop-shaped cross-section and extends into the reclosable profile when fully inserted into the slider. When the slider is moved along the container edge in a prescribed direction, the retaining member 400 wedges the reclosable profile open.

Figure 5:
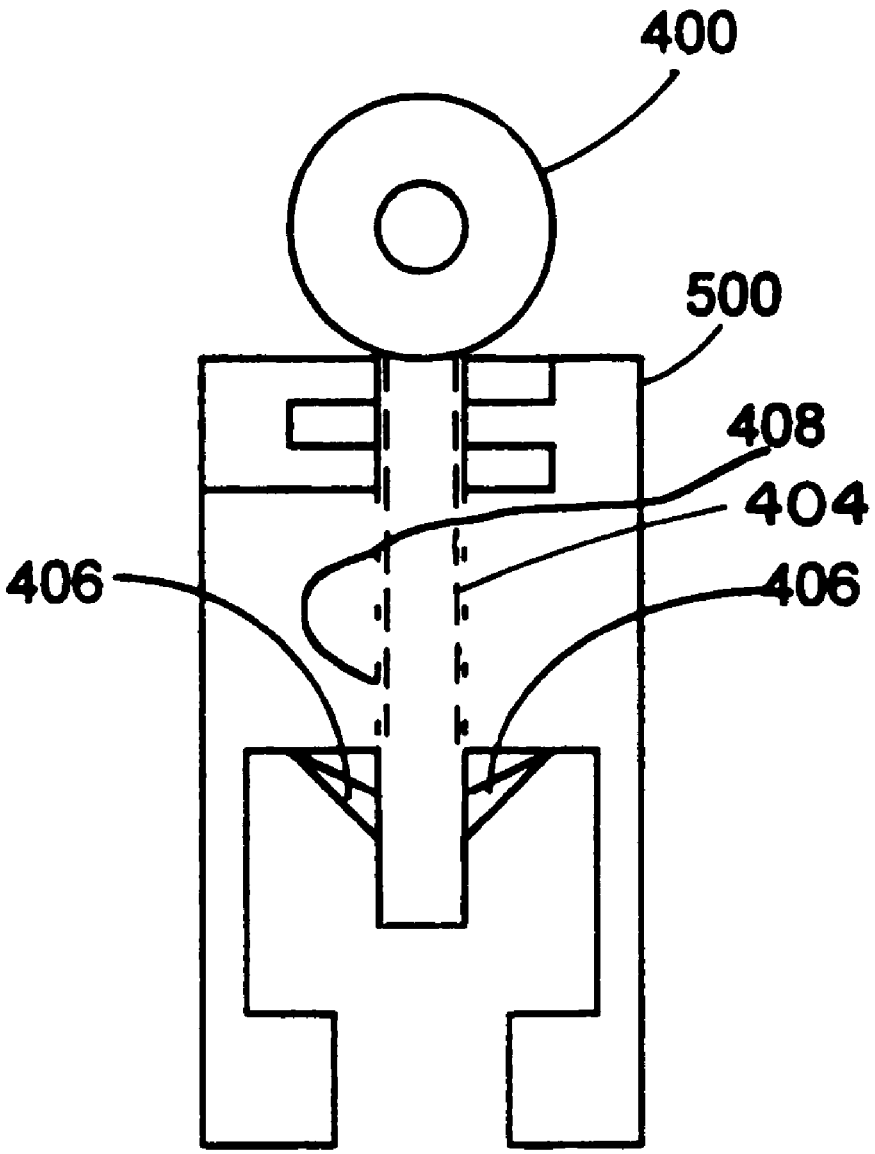
FIG. 5 illustrates a cross-sectional view of the retaining member of FIGS. 4*a* and 4*b* inserted into a slider to form a fastener arrangement, according to an embodiment of the present invention.

FIG. 5 illustrates the retaining member 400 of FIG. 4 inserted into a slider 500, according to an embodiment of the present invention. It should be understood that, while the dimensions illustrated in FIG. 5 are not precisely proportional to those illustrated in FIG. 3, the particular dimensions illustrated in the figures are provided by way of example only and should not be construed to limit the invention. The choice of dimensions for a particular slider embodying the present invention are influenced by various design considerations, such as ergonomics and the characteristics of the reclosable profile. The stem portion 404 is inserted in a second cavity 408 that is formed, for example, by the apertures 316*a,* 316*b,* and 316*c* of FIG. 3 when the strip 300 is folded along the lines 302 and 304. The barb-like protrusions 406 enter a cavity 502 of the slider 500 and secure the retaining member 400 in the slider 500.

In an alternative embodiment of the present invention, the retaining member is held in place in the slider by frictional engagement. Frictionally securing the retaining member in the slider enables the retaining member to be manufactured without barb-like projections. Frictional engagement can be achieved, for example, by manufacturing the retaining member with a diameter larger than that of the cavity into which it is inserted. As still another alternative, a top piece is attached, e.g., glued or fastened, to the tops of the slider and of the retaining member to hold them together. In this embodiment, operating the slider involves gripping its sides and moving the slider in the desired direction.

The various embodiments described above are provided by way of illustration only and should not be construed to limit the invention. Those skilled in the art will readily recognize various modifications and changes that may be made to the present invention without strictly following the example embodiments and applications illustrated and described herein, and without departing from the true spirit and scope of the present invention, which is set forth in the following claims.

What is claimed is:

1. A reclosable package comprising:

a film having interior and exterior surfaces arranged to form a pouch;

a reclosable profile disposed proximate to an edge of the film;

a slider having first and second walls forming a first cavity for receiving the edge and the reclosable profile, the slider being positionable to slide along the edge in a first direction to close the reclosable profile; and a retaining member sized for location in the slider and configured and arranged to maintain the first and second walls in a position forming the first cavity and having a portion thereof that is positionable in the first cavity and shaped to open the reclosable profile when the slider is a portion thereof for location within a second cavity formed by the first and second walls to secure the retaining member in the slider; wherein each of the first and second walls has at least one projection for engaging the other of the first and second walls, and aligning apertures of the projections of the first and second walls form the second cavity for receiving the retaining member so that the retaining member locks the walls in interengagement.

2. A reclosable package, according to claim 1, wherein folding the first and second walls forms the first and second cavities.

3. A reclosable package, according to claim 1, wherein folding the first and second walls together causes the apertures of the projections of the first and second walls to align for forming the second cavity.

4. A reclosable package, according to claim 1, wherein the at least one of the projections of the first and second walls is sized to displace at least one other of the projections of the first and second walls for maintaining the first and second walls in a position to form the slider.

5. A reclosable package, according to claim 1, wherein the retaining member has a teardrop-shaped cross-section along at least a portion of its length and a locking expansion on a bottom portion of the member.

6. A reclosable package, according to claim 1, wherein the retaining member has a wedge-shaped cross-section along at least a portion of its length and a locking expansion on a bottom portion of the member.

7. A reclosable package, according to claim 1, wherein the retaining member is configured and arranged to extend into the reclosable profile for facilitating opening of the reclosable profile.

8. A reclosable package, according to claim 1, wherein the first cavity is wider at a first end of the slider than at a second end of the slider.

9. A reclosable package, according to claim 1, wherein the reclosable profile is disposed proximate to the container edge.

10. A reclosable package, according to claim 1, further comprising a skirt disposed between the reclosable profile and the container edge.

11. A reclosable package, according to claim 1, wherein the retaining member comprises at least one gripping extension emanating therefrom and configured and arranged for location within the second cavity to secure the retaining member in the slider.

12. A reclosable package, according to claim 1, wherein the retaining member is frictionally secured in the slider.

13. A reclosable package, according to claim 1, wherein the retaining member has a diameter larger than a diameter of the second cavity.

14. A reclosable package, according to claim 1, further comprising a securing member attached to the slider and to the retaining member for securing the retaining member in the slider.

15. A fastener arrangement for use with a container edge of a container having a reclosable profile, the fastener arrangement comprising:

a slider having first and second walls forming a first cavity for receiving the container edge and the reclosable profile, the slider being positionable to slide along the container edge in a first direction to close the reclosable profile; and a retaining member having a portion thereof configured and arranged for location within a second cavity in the slider to secure the retaining member in the slider and having a portion thereof that is positionable in the first cavity and shaped to open the reclosable profile when the slider is slid in a direction opposite the first direction; wherein each of the first and second walls has at least one projection for engaging the other of the first and second walls and the second cavity is formed by the projections of the walls so that the retaining member locks the walls in interengagement.

16. A fastener arrangement, according to claim 15, wherein folding the first and second walls forms the first and second cavities.

17. A fastener arrangement, according to claim 15, wherein folding the first and second walls together causes the apertures of the projections of the first and second walls to align for forming the second cavity.

18. A fastener arrangement, according to claim 15, wherein at least one of the projections of the first and second walls is sized to displace at least one other of the projections of the first and second walls for maintaining the first and second walls in a position to form the slider.

19. A fastener arrangement, according to claim 15, wherein the retaining member has a teardrop-shaped cross-section along at least a portion of its length.

20. A fastener arrangement, according to claim 15, wherein the retaining member has a wedge-shaped cross-section along at least a portion of its length.

21. A fastener arrangement, according to claim 15, wherein the retaining member is configured and arranged to extend into the reclosable profile for facilitating opening of the reclosable profile.

22. A fastener arrangement, according to claim 15, wherein the first cavity is wider at a first end of the slider than at a second end of the slider.

23. A fastener arrangement, according to claim 15, wherein the reclosable profile is disposed proximate to the container edge.

24. A fastener arrangement, according to claim 15, wherein the container comprises a skirt disposed between the reclosable profile and the container edge.

25. A fastener arrangement, according to claim 15, wherein the retaining member comprises at least one gripping extension emanating therefrom and configured and arranged for location within the second cavity to secure the retaining member in the slider.

26. A fastener arrangement, according to claim 15, wherein the retaining member is frictionally secured in the slider.

27. A fastener arrangement, according to claim 15, wherein the retaining member has a diameter larger than a diameter of the second cavity.

28. A fastener arrangement, according to claim 15, further comprising a securing member attached to the slider and to the retaining member for securing the retaining member in the slider.

* * * * *